United States Patent [19]

Brough et al.

[11] Patent Number: 4,632,241

[45] Date of Patent: Dec. 30, 1986

[54] PORTABLE DISPLAY BAG WITH SUPPORT MEANS

[75] Inventors: C. Duncan Brough, Summit, N.J.; Thomas W. Carroll, Wantagh, N.Y.

[73] Assignee: F. Schumacher & Co., New York, N.Y.

[21] Appl. No.: 657,534

[22] Filed: Oct. 4, 1984

[51] Int. Cl.[4] ..... B65D 5/50

[52] U.S. Cl. ..... 206/44 B; 190/1; 190/16; 190/18 R; 206/494; 211/45; 248/452

[58] Field of Search ..... 206/44 B, 487, 494, 206/495, 472, 493, 278, 286, 287, 287.1, 450, 526, 45.14, 45.13, 45.23; 190/1, 16, 18 R; 248/168, 169, 460, 461, 451, 452, 447, 447.1; 211/46, 45, 47

[56] References Cited

U.S. PATENT DOCUMENTS

| | | | |
|---|---|---|---|
| 1,086,746 | 2/1914 | Babbitt | 190/16 |
| 1,646,305 | 10/1927 | Meyers | 248/460 |
| 1,687,859 | 10/1928 | Fontaine | 211/46 X |
| 1,863,030 | 6/1932 | Ruwitch | 211/46 |
| 1,879,760 | 9/1932 | Moore | 248/460 |
| 1,951,695 | 3/1934 | Harter | 211/138 |
| 2,717,671 | 9/1955 | Arnold et al. | 206/287.1 |
| 2,887,196 | 5/1959 | Davis | 206/287.1 |
| 2,990,924 | 7/1961 | Plunkett | 190/41 |
| 3,000,416 | 9/1961 | Lindegren | 150/49 |
| 3,054,508 | 9/1962 | Lorella | 211/45 |
| 3,514,875 | 6/1970 | Howard | 190/16 X |
| 3,593,768 | 7/1971 | Taub | 150/49 |
| 3,724,617 | 4/1973 | Lawler | 190/16 |
| 3,737,013 | 6/1973 | Powell | 206/287.1 |
| 3,802,620 | 4/1974 | Ferrara | 232/19 |
| 3,965,583 | 6/1976 | Price | 211/45 X |
| 4,063,648 | 12/1977 | Fuller et al. | 211/45 |
| 4,128,176 | 12/1978 | Green | 211/45 |
| 4,189,035 | 2/1980 | Herz | 206/286 |
| 4,213,520 | 7/1980 | Sarna et al. | 190/16 |

FOREIGN PATENT DOCUMENTS

| | | | |
|---|---|---|---|
| 1044484 | 9/1966 | United Kingdom | 206/286 |

*Primary Examiner*—William Price
*Assistant Examiner*—Bryon Gehman
*Attorney, Agent, or Firm*—Kenyon & Kenyon

[57] ABSTRACT

A bag which is portable and adapted to be opened and erected on a display stand on which materials including fabrics, wallpaper, rugs and the like may be displayed to a prospective customer. The materials are attached to the bag on a support bar by means of tab members which allow for easy removal or insertion of the materials into the bag.

3 Claims, 6 Drawing Figures

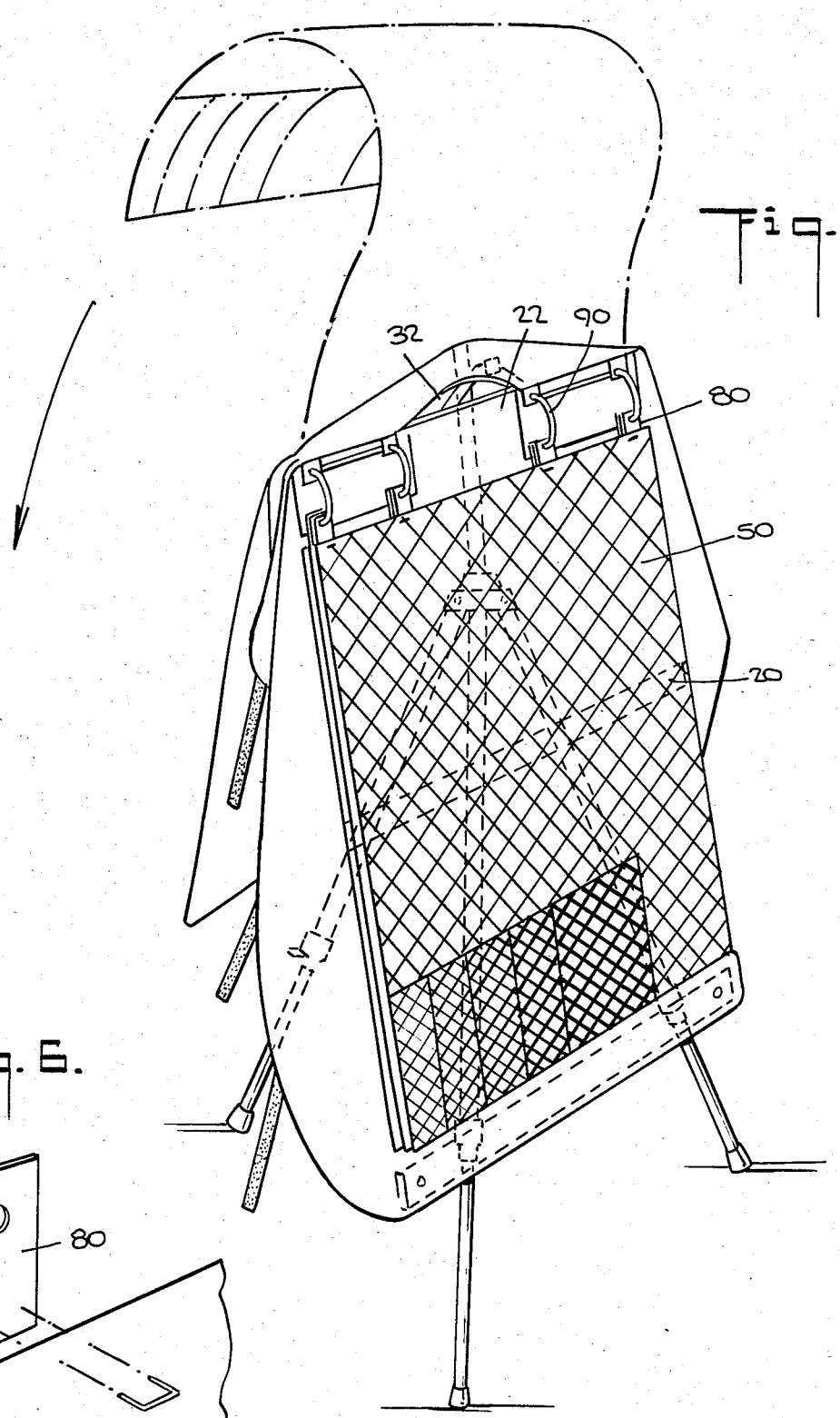
Fig. 1.
Fig. 6.
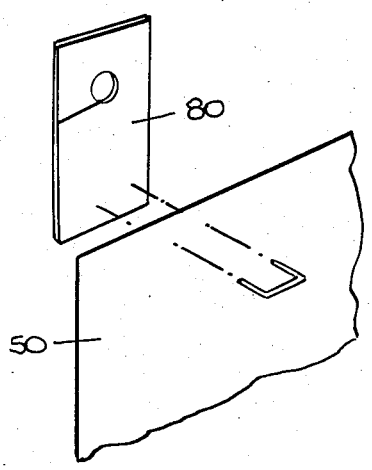

PORTABLE DISPLAY BAG WITH SUPPORT MEANS

BACKGROUND OF THE INVENTION

The present invention relates to a display bag for use in the transportation and display of various flat materials, including fabrics, wallpaper, rugs and the like.

Numerous instances occur in which it is desired to make a presentation in which articles must be transported and displayed at different facilities away from the home or office of the person making the presentation. One such situation occurs when a salesman visits a customer and desires for instance to present a new line of fabrics or wallpaper.

Heretofore, flat materials such as fabrics, wallpaper, rugs and the like have generally been transported for display to customers by packing the materials in some type of case. Display of the materials in this manner proved cumbersome as the materials had to be lifted out of the case and placed on some type of stand in order to be conveniently accessible to sight and touch. Moreover, the display of materials using the above method proved to be time consuming as time was required to physically remove materials from the case and then to place them back. Such a procedure does not lend itself to an efficient presentation of the goods to be displayed in that it is difficult to locate particular fabrics, maintain the goods in a presentable and unwrinkled state, all of which are of great importance to the prospective customer.

Attempts to improve conventional methods of display have resulted in the production of bulky display cases and racks which mandated the use of wheels for easy transportation. Attempts to develop a display case which both houses the materials to be displayed and utilizes the components of the case as a support for the materials during inspection and display thereof proved to be complicated to assemble. Furthermore, the rigid built-in support mechanism of these cases required space, thus decreasing the amount of space left in the case to hold the materials.

SUMMARY

The present invention relates to a display bag for the transporting and displaying of stacks of flat material such as fabrics, wallpaper, rugs and the like. The display bag is adapted to hold a plurality of sample fabrics. Each fabric is fastened to a plurality of tabs located at the top of the fabric which secures the fabric within the display bag. Each tab has an aperture, through which a plurality of support bars (equal to the number of tabs attached to each fabric) pass through to support each fabric. A slit is provided in each tab which communicates with the aperture therein to facilitate mounting and removal from the support bar. Each support bar is permanently attached at each of its ends to an end support plate so as to leave a space between the bar and the plane of the end support plate. The end support plates are disposed in the upper end of the display bag when in the open position. In this manner, the materials can be conveniently passed over the end support to facilitate display of the materials successively.

To arrange the bag in the carrying or transporting mode, the entire display bag, containing the fabrics, is easily folded over a median support. The median support member is provided at the center or the fold line of the display bag. A carrying means in the form of a handle or strap is fastened to the median support to enable a person to carry the display bag. A closure secures the bag at the bottom while in the carrying mode.

When it is desired to display the materials carried in the display bag, the bag is unfolded, exposing the base cover flaps which cover and protect the materials contained therein. The bag is opened and then mounted onto a stand by means of a mounting handle which is permanently secured to the end support member at the upper end of the bag. The base cover flaps are readily opened by unfastening the closure straps utilized while in the carrying mode. Thereafter, the flaps are opened and expose the materials contained in the bag for display. Successive display of each fabric is made by simply folding each fabric over the end support and thus over the stand.

It is accordingly an object of the present invention to provide a portable display bag for transporting and displaying stacks of flat materials, which utilizes a separate stand to support the entire bag during the display of materials.

Another object of the present invention is to provide a portable display bag which conveniently covers and protects the materials contained therein.

A further object of the present invention is to provide a display bag in which the materials to be carried and displayed may be readily rearranged and/or interchanged with other materials.

These and other objects and advantages of the present invention will become apparent from a reading of the following specification taken in conjunction with the drawings.

BRIEF DESCRIPTION OF THE DRAWINGS

FIG. 1 is a perspective view of the portable display bag of this invention showing the bag in a fully open position on an appropriate stand;

FIG. 6 is an enlarged view of a tab.

DESCRIPTION OF THE PREFERRED EMBODIMENT

Figure 2:
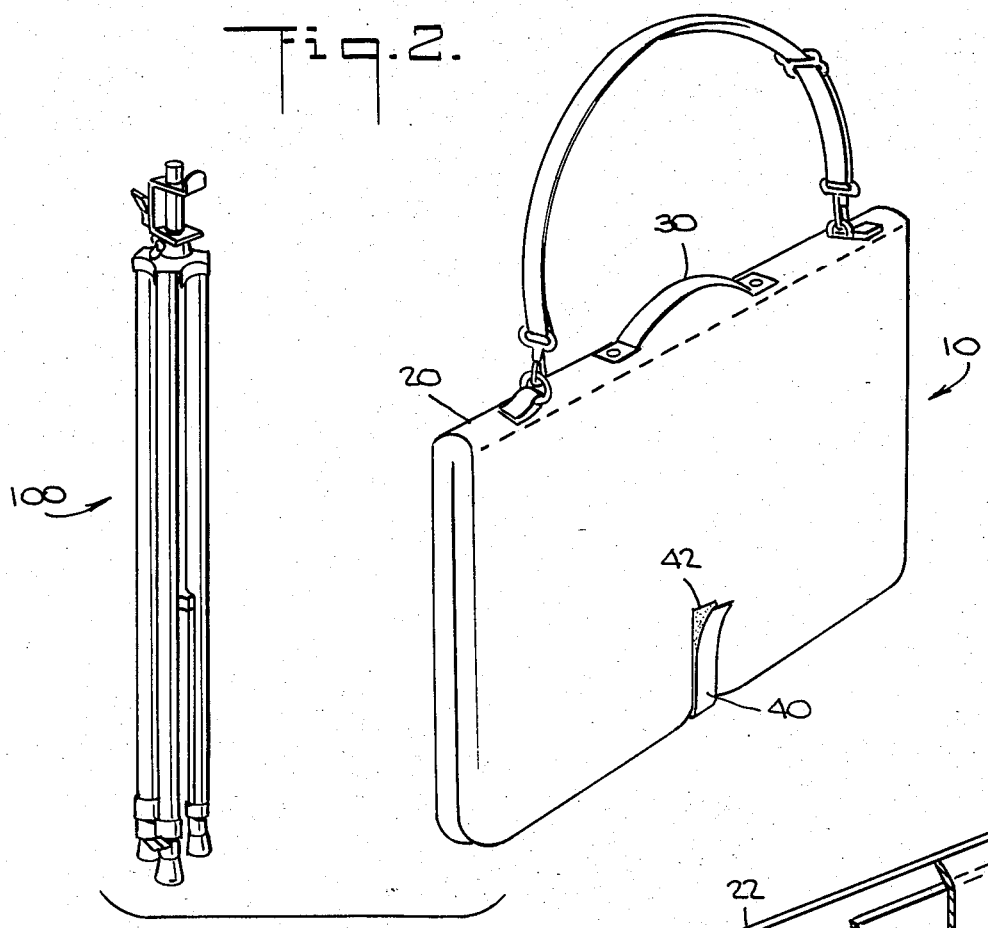
FIG. 2 is a perspective view of a portable display bag showing the bag in a fully closed position (carrying mode) with a separate stand.

Referring to FIG. 2, the display bag is shown in the carrying mode (closed position) and includes a base cover, generally indicated at 10. The base cover is preferably a nylon or canvas type fabric which is durable and light in weight. The display bag folds in half at the median support, indicated at 20 (see also FIG. 1) which extends across the entire width of the bag. Folding over median support 20 serves to position the display bag in the carrying mode pictured in FIG. 2. Median support 20 is attached to base cover 10 by appropriate fastening means across the width of the bag. A carrying handle 30 is attached to median support 20 to facilitate carrying of the bag. As an alternative or in conjunction with the handle 30, a carrying strap **30*a* may be provided. A strap 40 is used to close the display bag in the carrying mode (FIG. 2) by extending it over to the other side of the base cover where it easily attaches to a strip of nylon velour 42. Other conventional fastening means may also be employed. The strip of nylon 42 is permanently stitched to base cover 10**.

Figure 5:
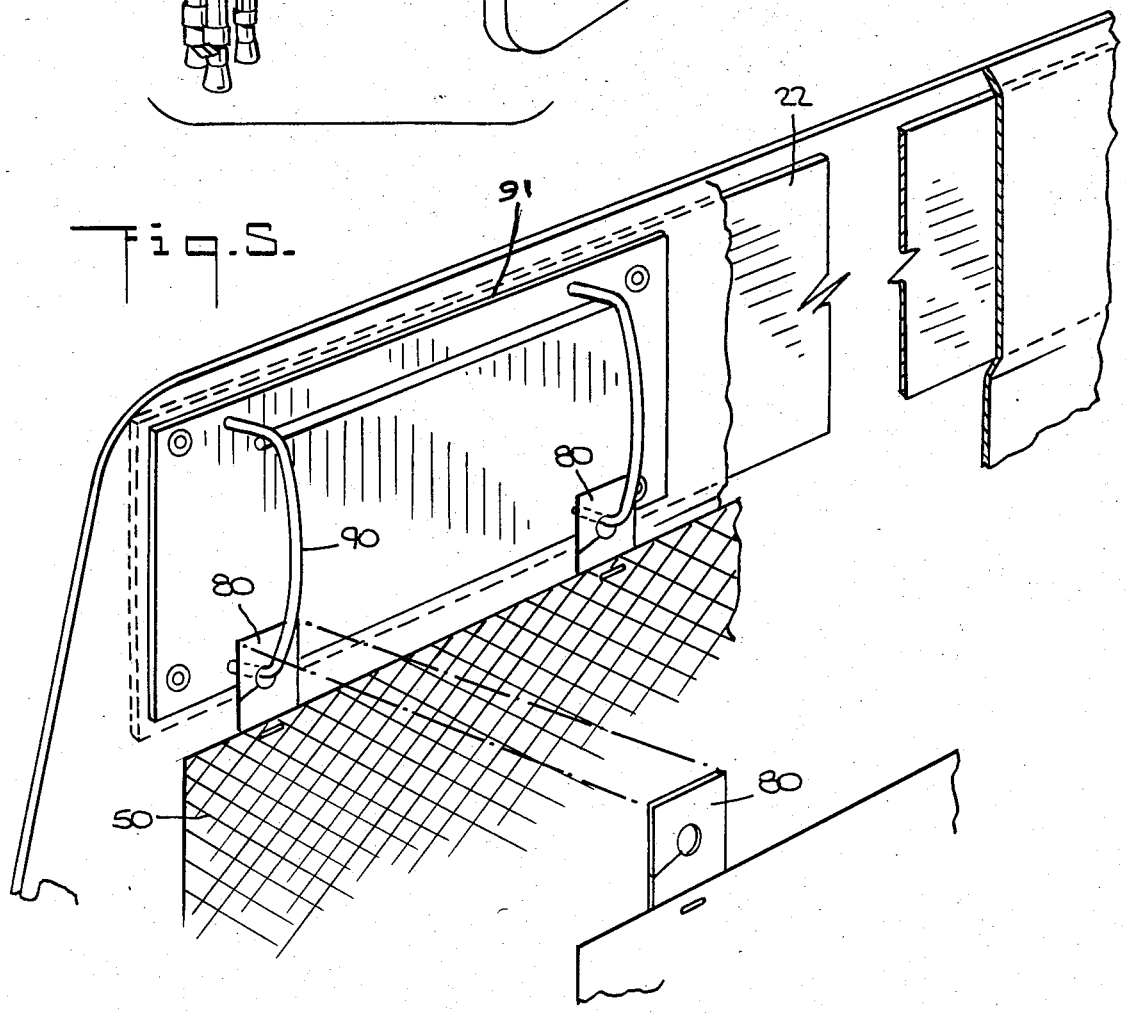
FIG. 5 is an enlarged view of the end support and the plurality of support bars which are adapted to receive appropriately located tabs fastened to the fabric.
Figure 3:
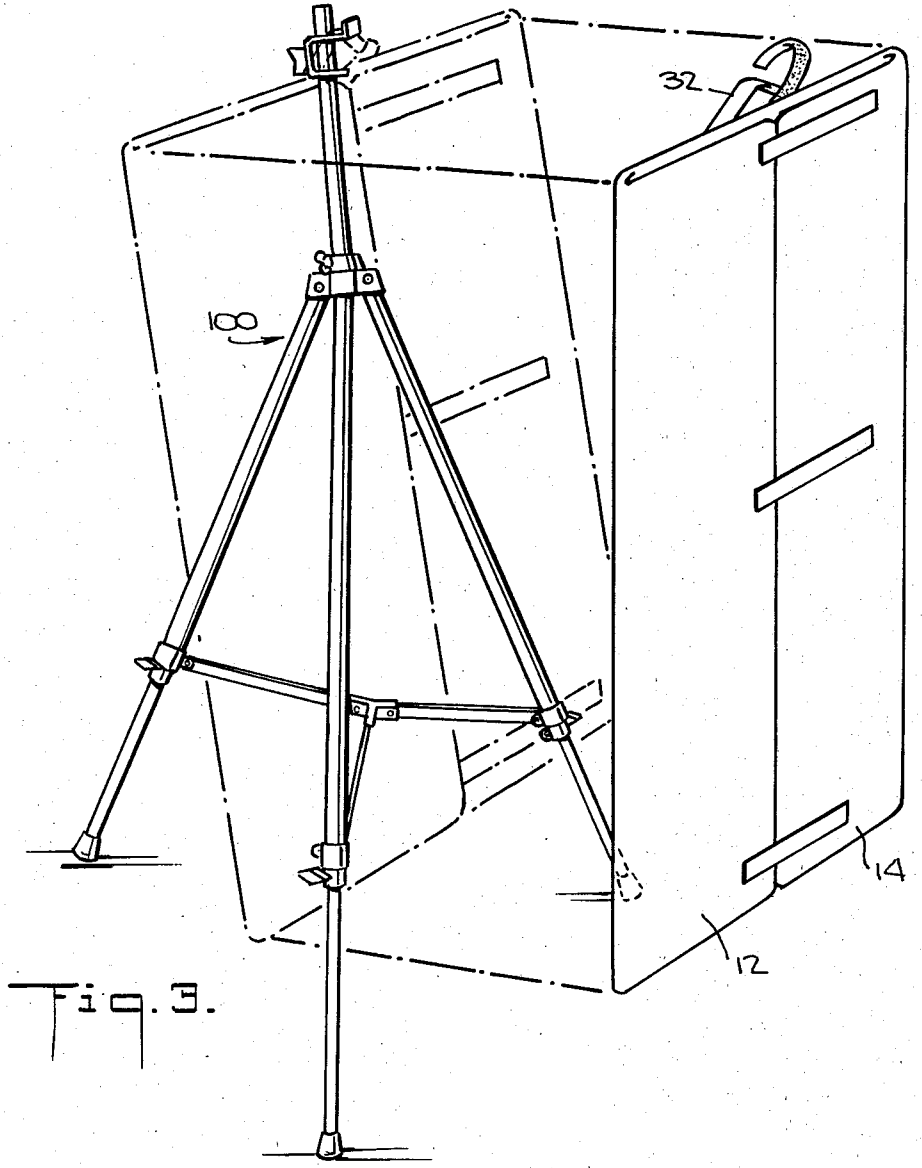
FIG. 3 is a perspective view of the manner in which a partially opened display bag is mounted onto a stand.

Referring to FIG. 3, mounting handle 32 is provided at the top of the display bag and is used to mount the display bag onto a conventional tripod stand 100. Mounting handle 32 is attached to an end support member 22 which extends across the entire width of the bag (see FIGS. 1, 4 and 5). Both mounting handle 32 and end support member 22 are permanently attached to the same end of the base cover 10 (upper end in open position).

Figure 4:
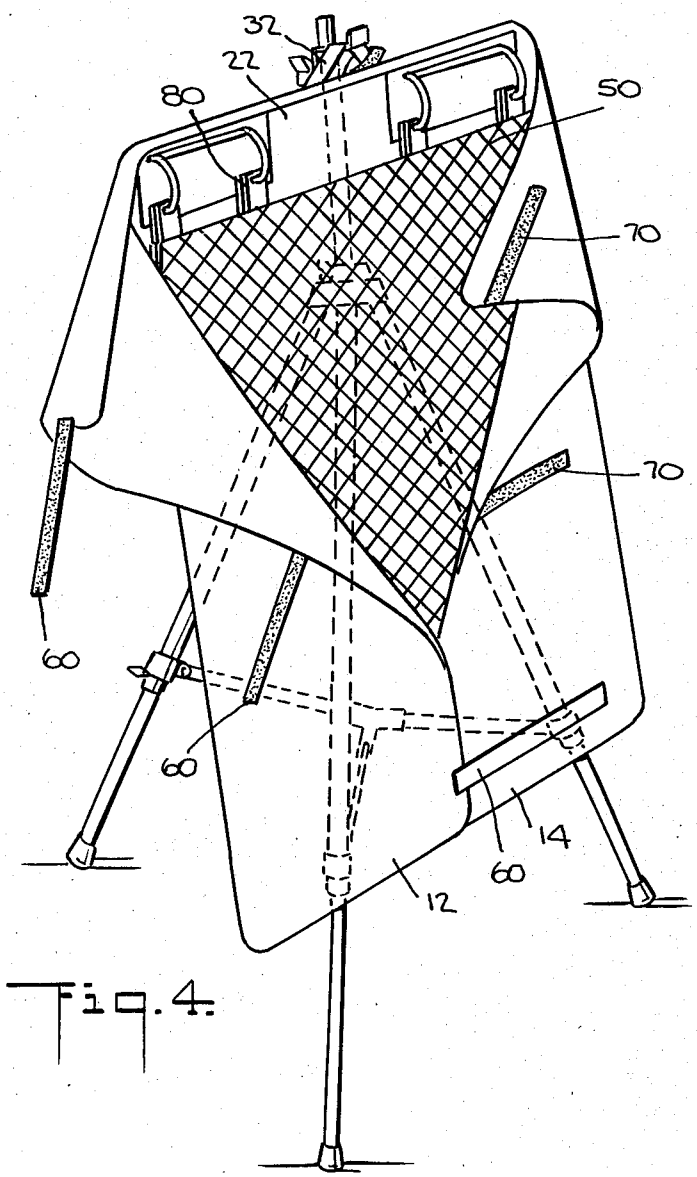
FIG. 4 is a perspective view of the manner in which the base cover of the display bag is opened to expose the materials therein.

FIG. 4 depicts how the base cover 10 wraps around the materials contained in the display bag. Base cover flaps 12 and 14 converge from both sides of the bag to cover the materials inside. A plurality of straps 60 are each stitched on one of the flaps 12 and 14. A plurality of nylon velour strips 70, equal in number to their corresponding straps 60, are stitched to the other flaps 12 and 14. The free ends of the strips 70 attach onto the nylon straps to keep the base cover flaps closed.

Opening the base cover flaps 12 and 14 exposes the materials to be displayed, indicated generally by 50. Each fabric is attached to four tabs 80, two being located at each end of the fabric. Each tab 80 has an aperture 81 through which it receives support bar 90. Each tab 80 is provided with a slit 82 which extends from the edge of tab 80 to aperture 81 so that the tab 80 may be easily mounted onto and removed from the support bars 90 when it is desired to change the materials in the display bag. Each support bar 90 is vertically attached at both of its ends to an end plate 91 which is attached to the end support member 22. Only the ends of the bars 90 are attached to plate 91, leaving sufficient space between the length of the bar and the plane of end plate 91 so as to enable tabs 80 to traverse the length of each bar 90. In this manner, the materials to be displayed may be passed over the end support, thus permitting successive display.

Thus, there has been described a display bag which is portable and adapted to be utilized as a display for prospective customers in a convenient and effective manner. Further, the bag of this invention facilitates an impressive display of the contents of the bag to the customer(s) and allows for display of a great number of different items. Thus, although the inventive concept has been described in the terms of a specific embodiment and particular applications, persons skilled in the art can generate additional embodiments without departing from the spirit or exceeding the scope of the invention. Thus, the description of the specific embodiment in this disclosure are illustrative and should not be construed to limit the scope thereof.

What is claimed is:

1. A portable display bag assembly comprising:

(a) a generally upright stand means;

(b) a foldable portable display bag separate from the stand means for use in the transporting and displaying of flat materials such as fabrics, wallpaper, rugs and the like;

said foldable bag comprising:

(i) a foldable fabric cover having integral flaps and fastening means for closing said flaps, said cover capable of displaying the materials when the flaps are open and completely enclosing the materials when the flaps are closed;

(ii) median support means attached to the cover along the width of the display bag at a point approximately intermediate the length of the display bag, said cover folding over the median support means to position the display bag in a folded carrying mode;

(iii) carrying means attached to the median support for transporting the display bag in a folded carrying mode;

(iv) end support means attached to the cover along the width of the display bag at an end of the length of the display bag, said end support means including a mounting handle for mounting the display bag onto a projection of the stand means when the display bag is in an unfolded extended display mode;

(v) a plurality of generally flat pieces of display material having lengths substantially greater than the length of the display bag when in its folded carrying mode;

(vi) at least a pair of tab means attached to each piece of said display material, each of said tabs including an aperture therein and having a slitted opening communicating with said aperture;

(vii) a plurality of support bars each of which is attached only at both of its ends to the ends support means in the direction of the length of the display bag, at least a pair of said support bars receiving said pair of tab means for supporting the pieces of display material, whereby the pieces of display material may be flipped over the end support and the top of the stand means for successive display when the display bag is in its extended display mode.

2. The display assembly of claim 1 wherein said tab means has the aperture in the approximate center thereof.

3. The display bag of claim 1 wherein said end support means comprise a base support member which extends for substantially the entire width of said display bag, a pair of bar support plates mounted to said base support member, and a pair of said support bars attached to each of said bar support plates for receiving the tabs supporting the material to be displayed.

* * * * *